US006168160B1

(12) United States Patent
DeOreo et al.

(10) Patent No.: US 6,168,160 B1
(45) Date of Patent: Jan. 2, 2001

(54) RING TOSS GAME WITH MOVING TARGET

(75) Inventors: Daniel J. DeOreo, Manchester, MA (US); Yoshizo Nagasaka, Tokyo (JP)

(73) Assignee: Hasbro, Inc., Pawtucket, RI (US)

( * ) Notice: Under 35 U.S.C. 154(b), the term of this patent shall be extended for 0 days.

(21) Appl. No.: 09/321,767

(22) Filed: May 28, 1999

(51) Int. Cl.[7] ..... F41J 9/00

(52) U.S. Cl. ..... 273/374; 273/359; 273/336; 273/378; 273/381; 273/369; 273/370; 446/268; 446/297; 446/298; 446/376

(58) Field of Search ..... 273/348, 359, 273/371, 374, 375, 376, 378, 381, 336, 369, 370; 446/268, 297, 298, 330, 376, 390

(56) References Cited

U.S. PATENT DOCUMENTS

| | | | | |
|---|---|---|---|---|
| 1,547,273 | | 7/1925 | Trayers . | |
| 2,613,080 | * | 10/1952 | Dow | 273/374 X |
| 3,024,025 | * | 3/1962 | Richardson et al. | 273/336 X |
| 3,151,866 | * | 10/1964 | Glass et al. | 273/359 |
| 3,160,983 | * | 12/1964 | Smith et al. | 273/359 X |
| 4,726,591 | | 2/1988 | Johnson . | |
| 4,778,432 | | 10/1988 | Yeu . | |
| 4,804,192 | | 2/1989 | Matsumoto et al. . | |
| 4,913,676 | | 4/1990 | Koguchi et al. . | |
| 4,988,099 | * | 1/1991 | Kuna et al. | 273/359 X |
| 5,067,727 | | 11/1991 | Crompton . | |
| 5,697,617 | * | 12/1997 | Egging | 273/375 X |

* cited by examiner

*Primary Examiner*—Raleigh W. Chiu
(74) *Attorney, Agent, or Firm*—Fish & Richardson P.C.

(57) ABSTRACT

A game that includes a movable target is provided. To this end, the game includes an object that is thrown at the movable target. The movable target has a first movable element, a second movable element, a switch actuated by the thrown object, and a driving mechanism. The driving mechanism switches from moving the first movable element to moving the second movable element in response to actuation of the switch. Switch actuation occurs when the thrown object encircles the movable target and strikes an appendage of the movable target.

37 Claims, 6 Drawing Sheets

RING TOSS GAME WITH MOVING TARGET

TECHNICAL FIELD

This invention relates to a ring toss game that provides a moving target.

BACKGROUND

Ring toss games such as the game of quoits are well known. In the game of quoits, a player pitches iron or rope rings at a stake with a goal of encircling the stake with a ring.

SUMMARY

The invention provides a movable target for a throwing game in which the target is intended to receive a thrown object. To this end, the target includes a first movable element, a second movable element, a switch actuated by the thrown object, and a driving mechanism. The driving mechanism switches from moving the first movable element to moving the second movable element in response to actuation of the switch.

Embodiments may include one or more of the following features. For example, the target may be in the shape of an animal, such as a seal. The first movable element may include one or more first movable sub-elements (e.g., a body, a neck, and a head). Furthermore, moving the first movable element may include moving one of the first movable sub-elements relative to another one of the first movable sub-elements.

Similarly, the second movable element may include one or more second movable sub-elements (e.g., arms and a sound element). Moving the second movable element may include moving one of the second movable sub-elements relative to another one of the second movable sub-elements.

The movable target may further include a base element that supports the movable elements. Additionally, the first movable element may include a lower element, a middle element attached to the lower element, and an upper element attached to the middle element. Thus, moving the first movable element may include moving the lower element relative to the base, moving the middle element relative to the lower element, and moving the upper element relative to the middle element.

Moving the lower element relative to the base may include moving the lower element forward and backward relative to the base. Likewise, moving the middle element relative to the lower element may include moving the middle element from side to side relative to the lower element. Lastly, moving the upper element relative to the middle element may include moving the upper element from side to side relative to the middle element.

The second movable element may include one or more arm elements attached to the first movable element and a sound element housed in the movable target. Moving the second movable element may include moving one or more arm elements relative to the first movable element, and moving the sound element, which may cause sounds to be emitted from the sound element. Moving an arm element may occur in synchronization with moving the sound element. The thrown object may include a ring and the switch may be activated when the ring encircles the movable target and strikes an appendage. Moving the second movable element may include doing so for a predetermined time after the switch is activated.

The thrown object may include a ring. The ring may include two releasable semi-circular sections that fit together to form the ring.

Other features and advantages will be apparent from the following description, including the drawings, and from the claims.

DETAILED DESCRIPTION

Figure 1:
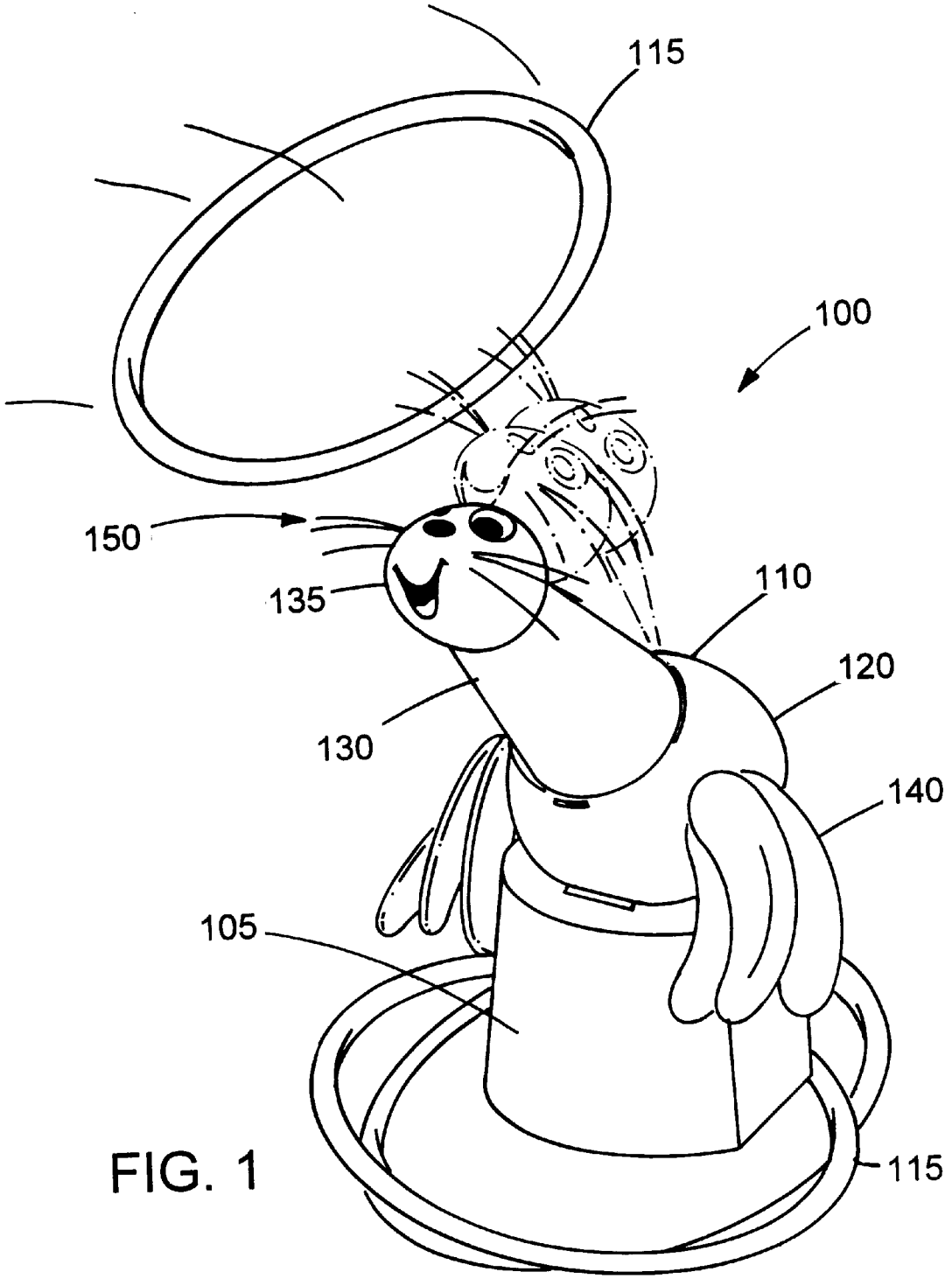
FIG. 1 is a front perspective view of a ring toss game that provides a moving target.
Figure 2:
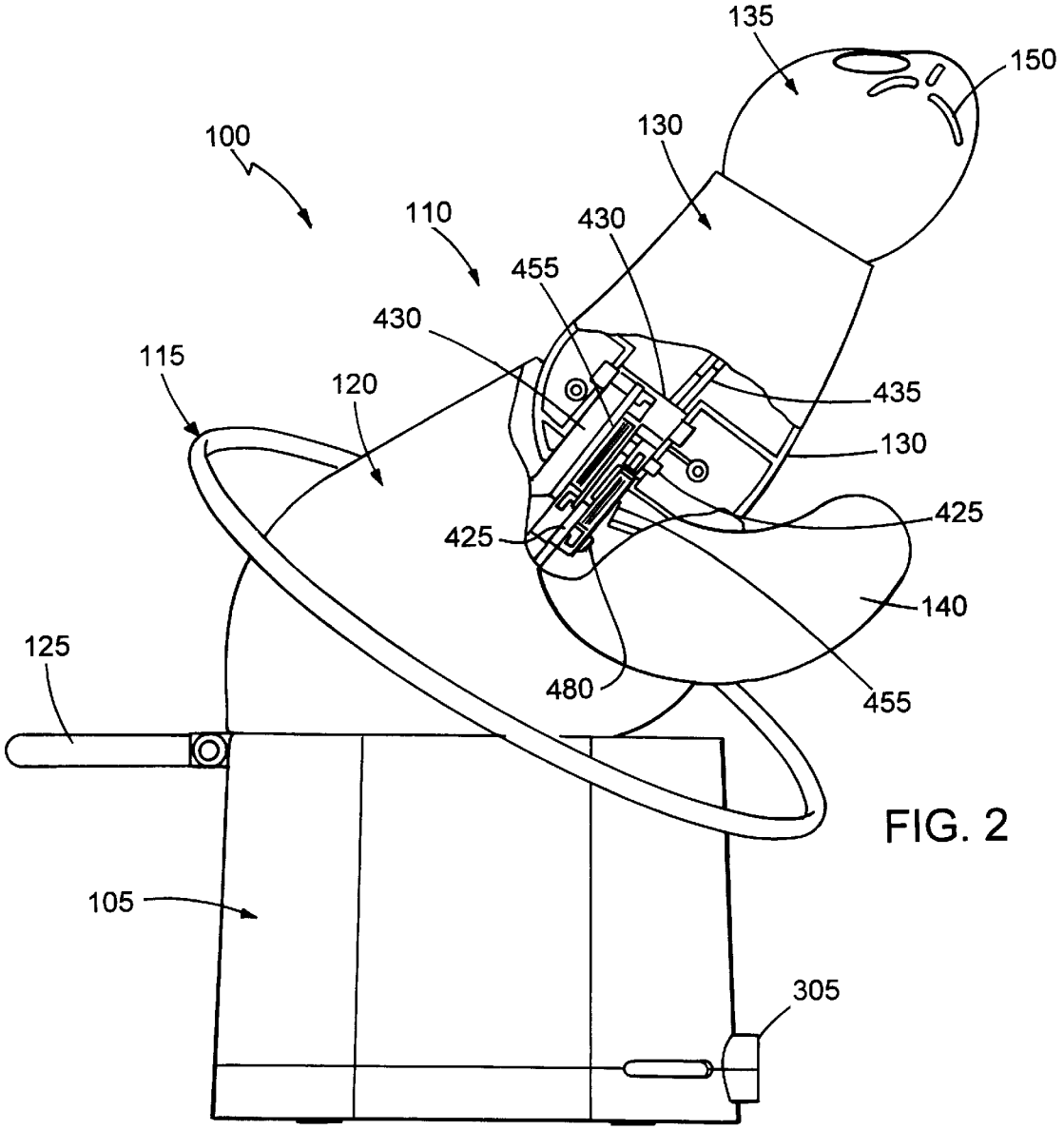
FIG. 2 is a side view of the ring toss came.

Referring to FIGS. 1 and 2, a ring toss game 100 includes a base 105, a target figure 110 in the shape of a seal and one or more rings 115 that a player throws towards and over the figure 110. The target figure 110 is mounted on the base 105. In operation, the target figure 110 moves relative to the base. The game 100 rewards a player with sounds and actions when a thrown ring encircles the FIG. 110.

The target figure 110 includes a body 120 that is mounted to the base 105 and is configured to rock forward and backward about a body pivot positioned at the base 105. A tail 125 is attached to the body 120 at a tail pivot inside the base 105, and is configured to move about the tail pivot. A neck 130 couples a head 135 to the body 120, and is configured to rock from side to side relative to the body 120. The head 135, in turn, moves from side to side relative to the neck 130. Arms 140, fastened to the body 120 at an arm pivot, are configured to make a clapping motion relative to the body 120. Within the body 120 and affixed to the base 105, a box 145 (shown in FIG. 4) holds many of the active components of the game 100.

As noted above, the target figure 110 is in the shape of a seal. To better depict the seal, whiskers 150 may be attached to protrude from the head 135 of the seal. The whiskers may be formed of any pliable material such as plastic. Likewise, the arms 140 may be shaped like flippers that have the paddlelike shape of seal flippers. Furthermore, movement of the body 120, neck 130, head 135, and flippers 140 may realistically mimic corresponding movement in a live seal. For example, a live seal that moves its neck to one side would simultaneously move its head to the other side to keep its center of gravity unchanged relative to the ground. Thus, the head 135 of the figure 110 is configured to move in a direction opposing the direction of movement of the neck 130.

The target figure 110 and its various parts may be formed of a lightweight plastic material to ease maneuverability and reduce manufacturing costs. The base 105 may be formed of a suitable rigid plastic material and may house additional components that cannot fit in the target figure 110. The rings may be formed of a lightweight plastic material of various colors for use in multi-player game play. Furthermore, each ring may be formed of two semi-circular sections that easily mate into the annular shape. This configuration reduces the amount of packaging required to transport and house the game 100 and permits players to form multi-colored rings.

Figure 3:
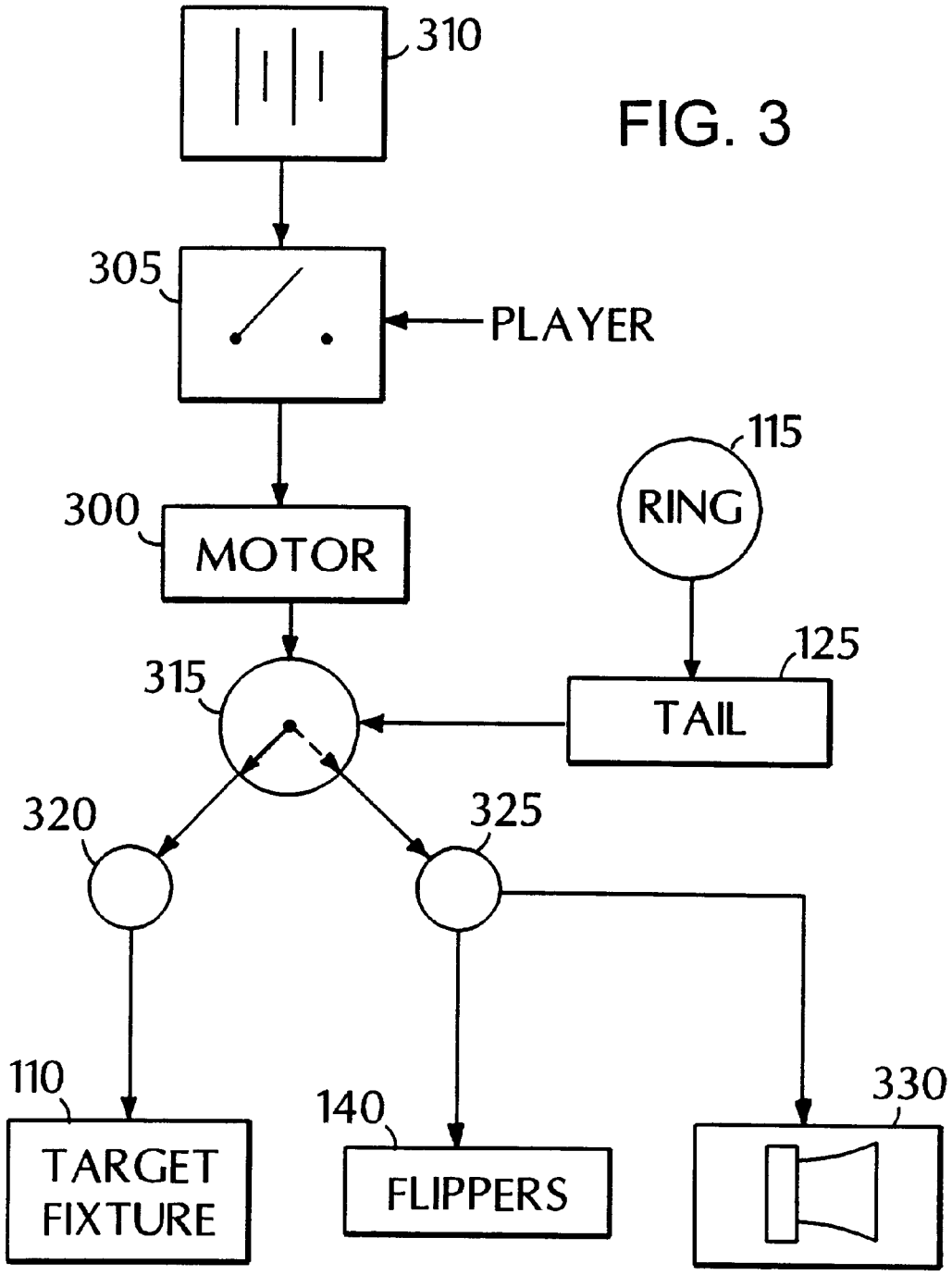
FIG. 3 is a block diagram showing operation of the ring toss game.

Referring also to FIG. 3, during game play, a motor 300 inside the body 120 is actuated by an ON/OFF switch 305 on the front of the base 105 to cause movement of the target figure 110. A power source 310, such as a battery, may be used to supply electrical power to the motor. When the player tosses a ring 115 to encircle the target figure 110, the ring strikes and moves the tail 125, which signals the game 100 to reward the player. When the tail 125 is forced down by the ring 115, the tail actuates a change lever 315 that changes, for a preset time, mechanisms used to affect movement in the target figure 110. Normally, target mechanisms 320 couple to the target figure 110 to move the head 135 and neck 130 from side to side, and to move the body 120 forward and backward. However, the change lever 315, activated by the tail 125, selects a different set of reward mechanisms 325 which couple to the target figure 110 to perform one or more actions that are different from the actions described above. For example, if the target FIG. 110 is a seal, the reward mechanisms 325 produce barking sounds using a sound mechanism 330 and simultaneously move and rotate the flippers 140 to simulate a seal's clapping motion.

Figure 4:
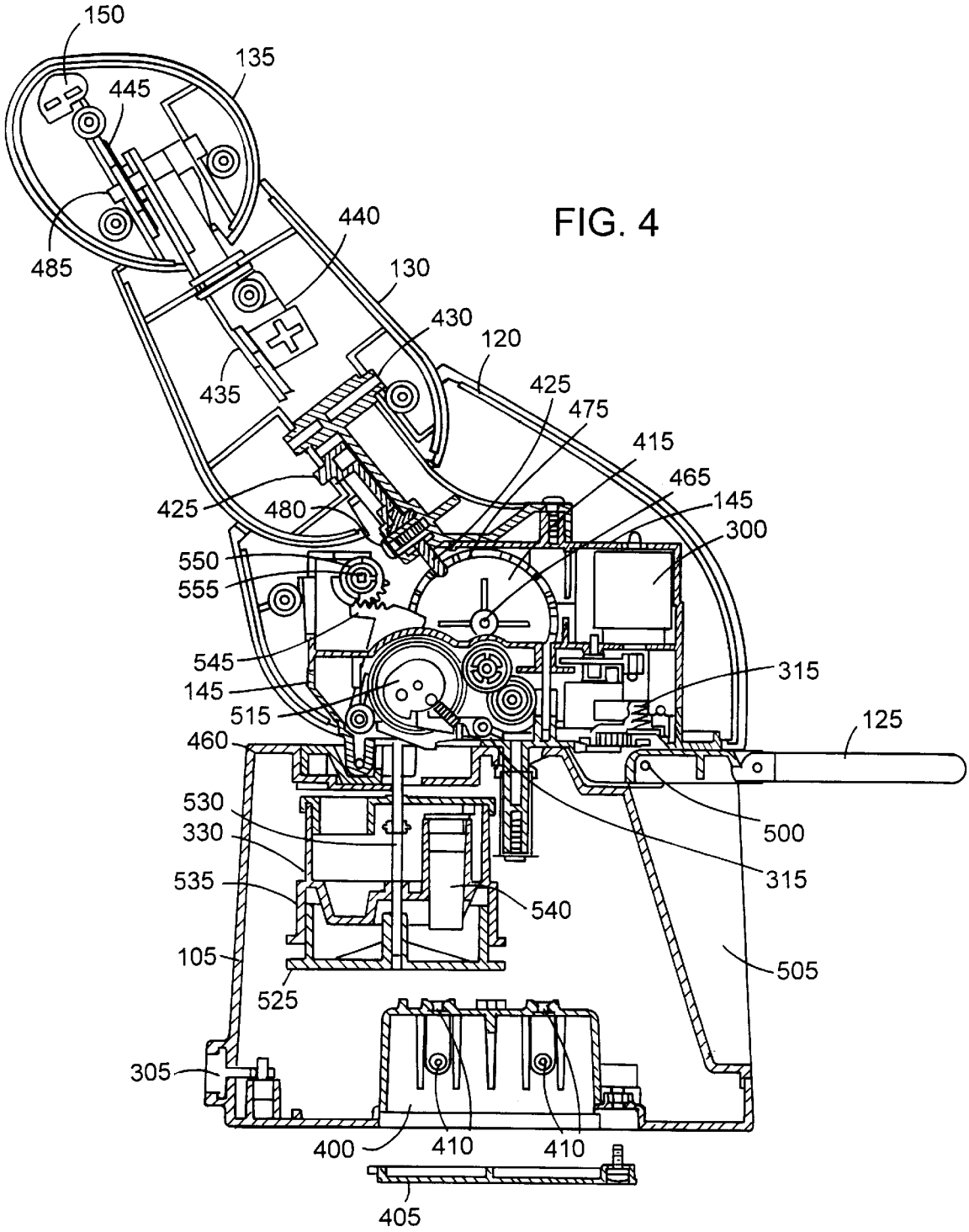
FIG. 4 is a side cross-sectional view of the ring toss game of FIG. 1 showing internal mechanisms that operate the game.
Figure 5:
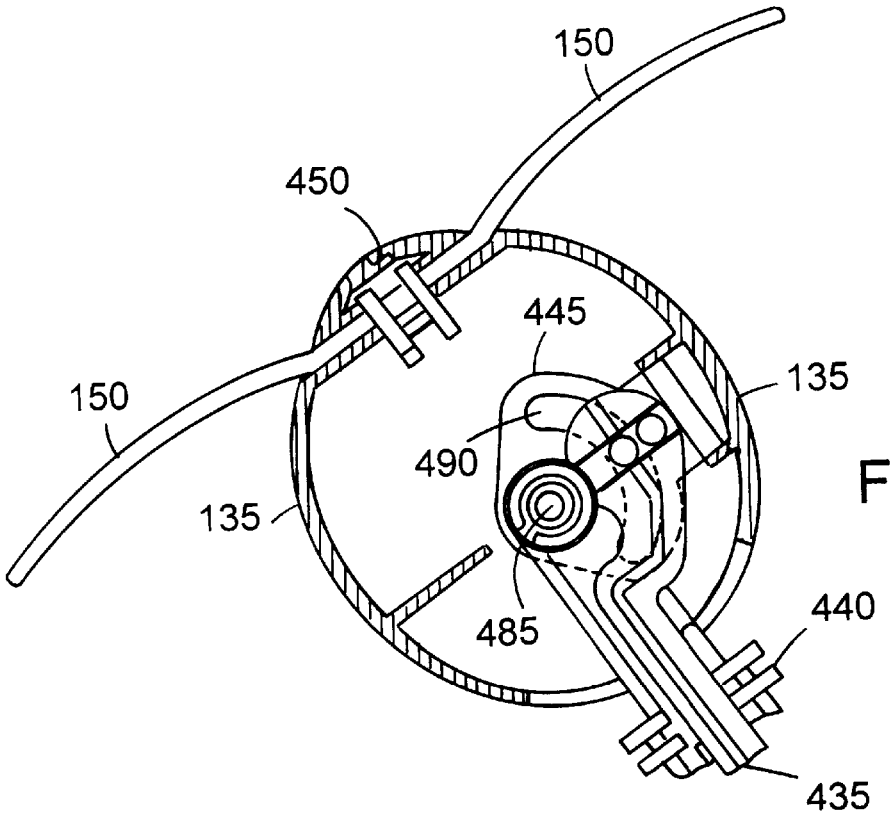
FIG. 5 is a top cross-sectional view of a head of the ring toss game.
Figure 7:
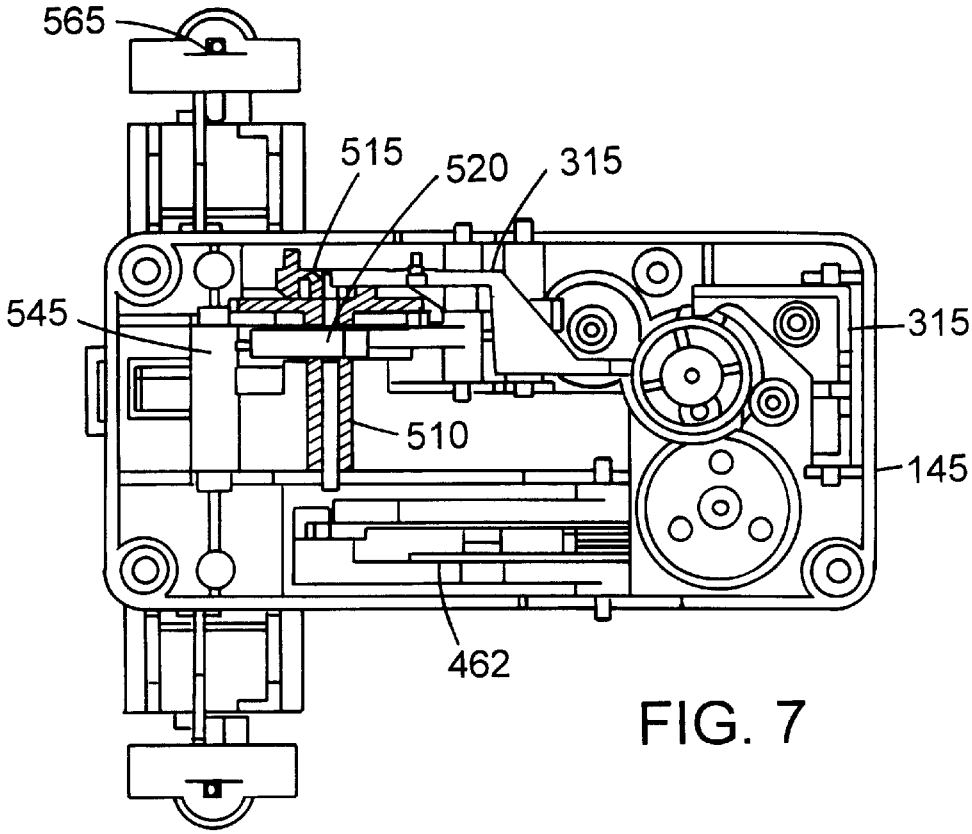
FIG. 7 is a cross-sectional bottom view from inside the ring toss game.
Figure 6:
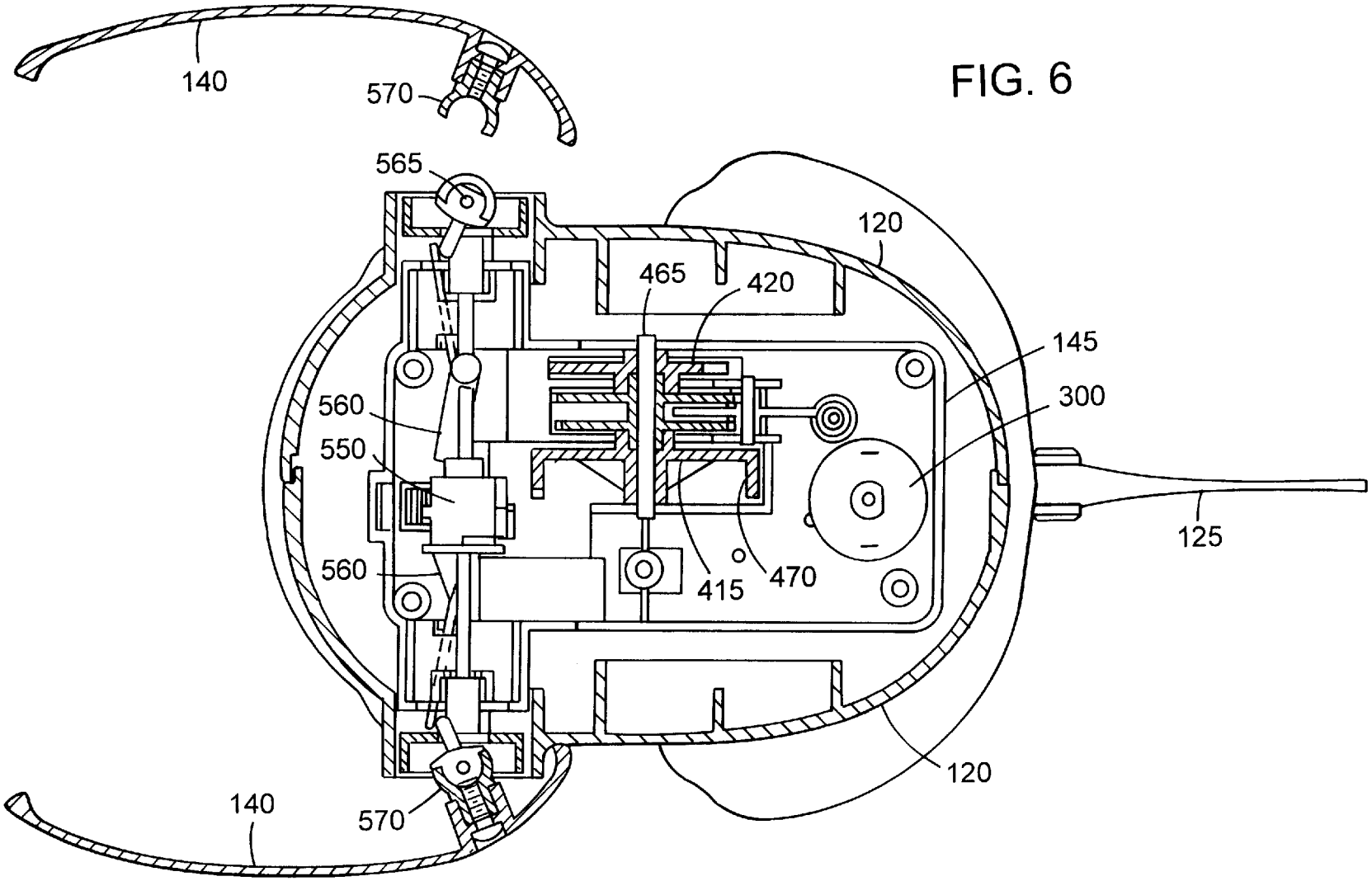
FIG. 6 is an aligned sectional top view through the ring toss game.

FIGS. 4–8 provide detailed information about assembly and operation of the ring toss game 100. FIG. 4 is a side cross-sectional view of the ring toss game 100 which shows the target mechanisms 320 and reward mechanisms 325 in addition to various other devices in the base 15 and the target figure 110 that facilitate game play. FIG. 5 is a top cross-sectional view of the head 135 of the target figure 110. FIG. 6 is an aligned sectional top view through the body 120, and FIG. 7 is a cross-sectional bottom view from inside the body 120.

As shown in FIG. 4, the batteries 310 are secured in a battery holder 400 formed in the base 105 and are retained within the battery holder 400 by a battery lid 405 that attaches to the battery holder 400. Electrical contacts 410 in the battery holder 400 make contact with terminals of the batteries.

The sound mechanism 330 is housed within and secured to the base 105.

The box 145 contains mechanical components, including the motor 300. The box 145 is located in the body 120 and secured to the base 105.

Target mechanisms 320 include a body cam 420 positioned inside the box 145. They also include a neck cam 415 positioned inside the box 145, a neck lever 425 that couples the neck cam 415 to the neck 130, and a neck stay 430 secured to the box 145 and protruding into the neck 130. Other target mechanisms include a head link 435 that couples the neck lever 425 to the head 135, a head stay 440 secured inside the neck 130 and to the head 135, and a head clutch plate 445 positioned inside the head 135 to facilitate head movement.

Torsion springs 450 and tension springs 455 are used by both the target mechanisms 320 and the reward mechanisms 325 to provide necessary return forces and torques as well as stabilization of the mechanisms 320, 325.

The tail 125 protrudes from the body 120 and rotates about the tail pivot 500. A base cavity 505 is formed in the base 105 directly below the tail pivot 500 to receive the moving tail 125.

Reward mechanisms 325 include a reward cam 510 that is positioned within the box 145 and engages both sound mechanism 330 and clapping mechanisms. The reward mechanisms also include a timer cam 515 that determines the preset time for which the reward is given. The sound mechanism 330 includes a sound lever 520 (shown in FIG. 7) coupled to a sound piston 525 by a sound rod 530. The sound piston 525 is movable within a sound cylinder 535 which houses a sound air path 540. The clapping mechanisms include a clap lever 545, an arm clutch 550 that rotates about an arm pivot 555, and an arm lever 560 (shown in FIG. 6) that rotates the arms 140 about a clap pivot 565 positioned in a shoulder area 570 of the flipper 140.

When power is supplied to the motor 300, the motor 300 operates on the various mechanical mechanisms in the box 145, including target mechanisms 320 and reward mechanisms 325. During normal operation, the change lever 315 causes the target mechanisms 320 that couple to the target FIG. 110 to move the head 135, neck 130, and body 120. An electrical path including the ON/OFF switch 305 and the motor 300 is formed when the battery contacts connect with the set of contacts 410 in the battery holder 400.

During target operation, the motor causes two primary motions in the target figure 110. First, the body cam 420, which connects to the body via a body lever 462, moves the body 120 forward and backward about the body pivot 460. Second, the neck cam 415 couples to the various other head and neck mechanisms—neck lever 425, neck stay 430, head link 435, head stay 440, and head clutch plate 445—to cause the neck 130 to move from side to side relative to the body 120 and to cause the head 135 to move from side to side relative to the neck 130.

In detail, during the second primary motion, the neck cam 415 rotates about a neck cam pivot 465 and irregularly-sized teeth 470 positioned along a neck cam rim 475 rotate the neck lever 425 about a neck lever pivot 480. The neck lever pivot 480 connects the neck lever 425 to the neck stay 430. Thus, the neck lever 425 rotates a distance from side to side about the neck lever pivot 480 that is dependent on the size of the teeth 470. The neck lever 425 and corresponding tension springs 455 couple directly to the neck 130 to cause the neck 130 to rotate from side to side. The irregular neck motion, due to the irregularly-sized teeth, better imitates the random movements of the seal.

As the neck 130 rotates from side to side, the head stay 440, which is fixed to a head pivot 485 within the head, remains stationary with respect to the neck 130 (that is, the head stay 440 moves in accordance with the motion of the neck 130). Simultaneously, the head link 435 (which, at its lower part, is fixed to the neck stay 430) is forced to move up and down relative to the head stay 440 to cause the head 135 to rotate from side to side about the head pivot 485. The head link 435 is coupled at its upper part to a semi-circular slot 490 formed in the head clutch plate 445 that is secured to the head pivot 485. As the head link 435 moves up and down, it slides back and forth through the slot 485 to cause the head 135 to rotate from side to side. The head's side to side motion is damped by the torsion spring 450 that couples the head pivot 485 to the head link 435.

When the player manages to throw the ring 115 over the target figure 110, the ring 115 strikes the tail 125, thus causing the tail 125 to rotate downward about the tail pivot 500 and into the base cavity 505 formed into the base 105. The base cavity 505 prevents the tail 125 from breaking by providing an unimpeded path within the base 105 for the moving tail 125. The downward movement of the tail 125 actuates the change lever 315 to select the reward mechanisms 325 and deselect the target mechanisms 325.

During reward operation, the reward mechanisms 325 cause the flippers 140 to move in a clapping motion and cause the sound mechanism 330 to produce a barking sound.

Because the sound mechanism 330 and the clapping mechanisms are both engaged by the reward cam 510, the barking sounds may be emitted in synchronization with flipper clapping motion.

Once the sound lever 520 is engaged by the reward cam 510, the sound lever 520 causes the sound piston 525 to move through the sound cylinder 535. As the sound piston 525 moves through the sound cylinder 535, air is forced through the sound air path 540 to produce the barking sound.

Additionally, the engaged clap lever 545 controls two primary clapping motions: flipper rotation and flipper clapping. The clap lever 545 initially engages the arm clutch 550 that rotates the flippers 140 about the arm pivot 555. Once the flippers 140 have pivoted to a final clapping position, the clap lever 545 then repeatedly engages the arm lever 560. The arm lever 560 claps each flipper 140 about the clap pivot 565 that is positioned in the shoulder area 570 of the flipper 140.

The reward cam 510 repeatedly engages and disengages the sound lever 520 in synchronization with the clap lever 545 for a length of time corresponding to the preset reward time set by the timer cam 515. When the preset reward time is over, the change lever 315 deselects the reward mechanisms 325 and re-selects the target mechanisms 320.

In an alternate embodiment, the flippers 140 may be removable from the shoulder area to prevent breakage during transport of the game.

In a further embodiment, the target figure 110 may imitate other animals or figures, such as, for example, a lion. In such a setup, the lion may have different target motions that are associated more with movement of the lion. For example, the lion's figure may lift its arm during target motion or wag its tail during target motion. Reward motions may include producing a lion's roar or causing the lion's figure to lift up on its hind legs.

Other embodiments are within the scope of the following claims.

What is claimed is:

1. A movable target game comprising:

an object that may be thrown at a target; and a target having:

a base, a first movable element coupled to the base, a second movable element coupled to the first movable element such that the first movable element is positioned between the second movable element and the base, a switch actuated by the thrown object, and a driving mechanism;

wherein the driving mechanism switches from moving the first movable element to moving the second movable element in response to actuation of the switch.

2. The target game of claim 1, wherein the first movable element comprises:

a body;

a neck attached to the body; and a head attached to the neck.

3. The target game of claim 2, wherein moving the first movable element comprises:

moving the body forward and backward relative to the base;

moving the neck from side to side relative to the body; and moving the head from side to side relative to the neck.

4. The target game of claim 1, wherein:

the target further includes a sound element, the driving mechanism switches from moving the first movable element to moving the sound element in response to actuation of the switch, and the second movable element comprises one or more arms attached to the body.

5. The target game of claim 4, wherein:

moving the second movable element comprises moving the one or more arms relative to the body; and moving the sound element causes sounds to be emitted from the sound element.

6. The target game of claim 5, wherein the target further comprises a tail and the switch is activated when the thrown object strikes the tail.

7. The target game of claim 6, wherein the object comprises a ring.

8. A movable target game comprising:

an object that may be thrown at a target; and a target having:

a first movable element that includes:

a body;

a neck attached to the body; and a head attached to the neck, a second movable element, a switch actuated by the thrown object, and a driving mechanism;

wherein the driving mechanism switches from moving the first movable element to moving the second movable element in response to actuation of the switch.

9. A movable target game comprising:

an object that may be thrown at a target, the object comprising a ring; and a target having:

a first movable element, a second movable element, a switch actuated when the ring encircles the movable target and strikes an appendage of the movable target, and a driving mechanism;

wherein the driving mechanism switches from moving the first movable element to moving the second movable element in response to actuation of the switch.

10. The target game of claim 9, wherein the first movable element comprises one or more first movable sub-elements.

11. The target game of claim 10, wherein moving the first movable element comprises moving one of the first movable sub-elements relative to another one of the first movable sub-elements.

12. The target game of claim 9, wherein the second movable element comprises one or more second movable sub-elements and moving the second movable element comprises moving one of the second movable sub-elements relative to another one of the second movable sub-elements.

13. The target game of claim 9, wherein the first movable element comprises:

a lower element;

a middle element attached to the lower element; and an upper element attached to the middle element.

14. The target game of claim 13, wherein the target further comprises a base element that holds the movable elements.

15. The target game of claim 14, wherein moving the first movable element comprises:

moving the lower element relative to the base;

moving the middle element relative to the lower element; and moving the upper element relative to the middle element.

16. The target game of claim 9, wherein the second movable element comprises:

one or more arm elements attached to the first movable element; and a sound element housed in the movable target.

17. The target game of claim 16, wherein moving the second movable element comprises:

moving the one or more arm elements relative to the first movable element; and moving the sound element;

wherein moving the sound element causes sounds to be emitted from the sound element.

18. The target game of claim 17, wherein moving an arm element occurs in synchronization with moving the sound element.

19. The target game of claim 9, wherein moving the second movable element comprises doing so for a predetermined time.

20. A movable target for a throwing game in which the target is intended to receive a thrown object, the target comprising:

a first movable element that includes:

a lower element, a middle element attached to the lower element, and an upper element attached to the middle element;

a second movable element;

a switch actuated by the thrown object; and a driving mechanism;

wherein the driving mechanism switches from moving the first movable element to moving the second movable element in response to actuation of the switch.

21. The target of claim 20, wherein the second movable element comprises:

one or more arm elements attached to the first movable element; and a sound element housed in the movable target.

22. The target of claim 21, wherein moving the second movable element comprises:

moving the one or more arm elements relative to the first movable element; and moving the sound element;

wherein moving the sound element causes sounds to be emitted from the sound element.

23. The target of claim 22, wherein moving an arm element occurs in synchronization with moving the sound element.

24. A movable target for a throwing game in which the target is intended to receive a thrown object, the target comprising:

a base;

a first movable element coupled to the base;

a second movable element coupled to the first movable element such that the first movable element is positioned between the second movable element and the base;

a switch actuated by the thrown object; and a driving mechanism;

wherein the driving mechanism switches from moving the first movable element to moving the second movable element in response to actuation of the switch.

25. The target of claim 24, wherein the first movable element comprises one or more first movable sub-elements.

26. The target of claim 25, wherein moving the first movable element comprises moving one of the first movable sub-elements relative to another one of the first movable sub-elements.

27. The target of claim 24, wherein the second movable element comprises one or more second movable sub-elements and moving the second movable element comprises moving one of the second movable sub-elements relative to another one of the second movable sub-elements.

28. The target of claim 24, wherein the first movable element comprises:

a lower element;

a middle element attached to the lower element; and an upper element attached to the middle element.

29. The target of claim 28, wherein moving the first movable element comprises:

moving the lower element relative to the base;

moving the middle element relative to the lower element; and moving the upper element relative to the middle element.

30. The target of claim 29, wherein moving the first movable element comprises:

moving the lower element forward and backward relative to the base;

moving the middle element from side to side relative to the lower element; and moving the upper element from side to side relative to the middle element.

31. The target of claim 24, wherein the second movable element comprises one or more arm elements attached to the first movable element.

32. The target of claim 31, wherein moving the second movable element comprises moving the one or more arm elements relative to the first movable element.

33. The target of claim 32, further comprising a sound element, wherein:

the driving mechanism switches from moving the first movable element to moving the sound element in response to actuation of the switch, moving the sound element causes sounds to be emitted from the sound element, and moving an arm element occurs in synchronization with moving the sound element.

34. The target of claim 24, wherein moving the second movable element comprises doing so for a predetermined time.

35. A movable target game including the target of claim 31, wherein the thrown object comprises a ring and the switch is activated when the ring encircles the movable target and strikes an appendage of the movable target.

36. A movable target game including the target of claim 24, wherein the thrown object comprises a ring.

37. The movable target game of claim 36, wherein the object comprises two semi-circular sections that fit together to form the ring.

* * * * *